US005408249A

United States Patent [19]

Wharton et al.

[11] Patent Number: 5,408,249

[45] Date of Patent: Apr. 18, 1995

[54] BIT EXTENSION ADAPTER FOR COMPUTER GRAPHICS

[75] Inventors: Daniel B. Wharton, McFarland, Wis.; York D. Anthony, Concord; James Wiley, Charlotte, both of N.C.

[73] Assignee: Radiation Measurements, Inc., Middleton, Wis.

[21] Appl. No.: 158,100

[22] Filed: Nov. 24, 1993

[51] Int. Cl.[6] ..... G09G 5/04

[52] U.S. Cl. ..... 345/147; 345/153

[58] Field of Search ..... 345/63, 77, 89, 147, 345/153, 22; 364/413.22; 348/671, 676; 273/437

[56] References Cited

U.S. PATENT DOCUMENTS 4,481,529 11/1984 Kerling ..... 345/147

OTHER PUBLICATIONS

Pacs Teleradiology, *Medical Electronics*, (Oct. 1993), pp. 124–128.

*Primary Examiner*—Jeffery Brier

*Attorney, Agent, or Firm*—Quarles & Brady

[57] ABSTRACT

A computer graphics interface for producing an enhanced gray scale image on a monitor having a plurality of separate color inputs. The graphics interface converts at least a first and a second analog signal corresponding to two n-bit digital bytes into a single enhanced signal representative of an x-bit digital byte (where x is greater than n). The interface has an interface input for receiving the analog signals from the computer, a divider for reducing the amplitude of the second analog signal by $2^n$ to produce an augmented signal, a summer for adding a first of the analog signals and the augmented signal to produce an enhanced signal, and means for conveying the enhanced signal to each of the monitor inputs. This interface is especially useful with a color VGA graphics board where n is 6.

9 Claims, 6 Drawing Sheets

BIT EXTENSION ADAPTER FOR COMPUTER GRAPHICS

BACKGROUND OF THE INVENTION

1. Field of the Invention

This invention relates to a device useful in enhancing gray scale images on various types of displays. More particularly, the invention provides a device which enables a computer using a VGA board to produce 7-bit (or higher) gray scale images on either a VGA monitor or gray scale monitor.

2. Description of the Art

Digital computer and monitor systems are now an integral part of the medical imaging process. These systems allow analysts to examine medical images in real time to quickly analyze clinical indications for purposes of diagnosis.

Because the diagnostic usefulness of a medical image is directly tied to the quality of the image, it is desirable to preserve as much image detail as possible. In many medical applications, gray scale images (i.e. images formed of shades of gray) are used as the principle diagnostic tool. When observing a colored image, the human brain may have difficulty perceiving color change as gradual, seamless change; instead, the brain sees color that starts and stops, as if there were a sudden characteristic change in tissue being observed. On the other hand, gray scale images readily show shading, crevices, cracks, indentations and other tissue characteristics in a realistic manner which is easy for the human eye to detect. Thus, much of the medical imaging industry has concentrated on producing gray scale images with enhanced detail as opposed to enhanced colored images.

In order to produce detailed gray scale images, the industry has developed customized imaging boards to drive various types (i.e. there is no widely recognized hardware standard for gray scale monitors) of gray scale monitors. As a different imaging board must be custom built to drive each different type of gray scale monitor, these boards can be prohibitively expensive for many applications. In addition, as these custom boards comprise specific hardware, these specialized gray scale systems require software to be written specifically for the hardware used thus extending development time and cost and limiting flexibility.

Unlike the gray scale monitors for which there is no monitor standard, the colored Vector Graphics Adapter (VGA) monitor has become the widely recognized standard for color monitors in the computer industry. The VGA monitor is now included as a standard piece of hardware with most personal computers. Attempting to take advantage of the abundance of VGA monitors to avoid the high costs associated with the specialized gray scale systems, the imaging industry has developed software that can be used with VGA monitors to produce gray scale images. While a VGA monitor and associated software is less expensive than the specialized gray scale systems, the quality of a gray scale image on a VGA monitor is inferior.

VGA graphics boards drive what are commonly known as raster type monitors wherein graphic images are created by displaying a large number of tiny dots, or pixels, having various brightness levels on the face of a monitor. An electron beam is magnetically deflected to excite each pixel on the monitor.

VGA monitors are full color monitors wherein each pixel is a triad of phosphorous dots in the three primary colors—red, green and blue. Three 6-bit digital data bytes, one byte corresponding to each dot, are stored in a computer memory and contain instructions for exciting each of the three dots. The data bytes are transferred to a digital to analog converter on a conventional computer display board to generate three separate analog video signals. The three analog video signals control the intensities of three electron beams, each beam directed at a different phosphorous dot.

As a 6-bit word defines the intensity of each electron beam, each electron beam can have a total combination of $2^6$ or 64 different intensity levels. To produce a black, white or gray pixel on a VGA monitor, the intensity of all three primary channels (red, green and blue) must be equal. Thus, a standard VGA system can generate gray scale images having only 64 unique gray shades. On the other hand, many of the specialized gray scale systems can produce $2^8$, $2^{10}$ or as many as $2^{12}$ different gray levels.

Often, subtle clinical information in a medical image is contained in image areas of only slightly different intensity. Due to the limitation on the gray scale image they can display, VGA images with only 64 different gray levels tend to look like topographic contour maps rather than being smoothly shaded across the gray scale. In many cases, inferior VGA images lack detail which is needed or would be useful for proper diagnostic purposes.

Therefore, it can be seen that there is a need for an inexpensive system to enable a relatively inexpensive monitor to be used to produce a high quality gray scale image with many different gray levels.

SUMMARY OF THE INVENTION

The present invention is summarized in that a computer graphics interface is positioned in series between a digital computer and a monitor for displaying gray scale images on the monitor, the monitor having a plurality of separate inputs. The computer maintains a discrete array of n-bit digital data bytes corresponding to each monitor input. The computer also has a digital to analog converter for converting the n-bit digital bytes into discrete analog signals corresponding to each monitor input. Each digital byte determines the amplitude of an associated analog signal and is capable of encoding $2^n$ different analog signal amplitudes.

The interface comprises an interface input for receiving all analog signals from the computer. A divider reduces a second of the analog signals to produce an augmented signal. A summer adds the first analog signal and the augmented signal to produce an enhanced signal. Then the enhanced signal is conveyed to each of the plurality of monitor inputs.

In a preferred embodiment, the monitor is a color VGA monitor having three color inputs where n is six and the divider reduces the second analog signal by $2^6$.

The digital byte data stored by the computer should be encoded gray scale image data rather than color coded data. The computer receives x-bit gray scale data (where x is greater than n) which is capable of producing $2^x$ different shades of gray. The computer stores the most significant n bits of the x-bit gray scale data as a first n-bit digital byte and stores the remaining x(-)n bits of the x-bit gray scale data as the most significant bits of a second n-bit digital byte. In this manner, x-bits of data can be stored in two separate n-bit memory positions.

In an embodiment employing a VGA monitor, the divider divides the second analog signal by 64 to produce an augmented signal which is relatively weak compared to the first analog signal. When the augmented signal is added to the first analog signal, the resulting enhanced analog signal can produce as many as $2^x$ (x being larger than 6) different analog signal amplitudes. This substantially increases the number of different shades of gray that can be produced on the VGA screen.

If x is greater than 12, n is 6, and even more shades of gray are desired, the additional x-bits can be stored in the third 6-bit byte. The interface can be equipped with a second divider for reducing the third analog signal to produce a second augmented signal. In the VGA embodiment, this is usually done by dividing the third analog signal by $2^{12}$ although other dividends could be used. Usually, in embodiments having two dividers, the summer adds the first analog signal, the augmented signal and the second augmented signal to produce the enhanced signal.

Thus, it is an object of the present invention to provide a simple and inexpensive interface which can produce high quality gray scale images on graphics monitors which are already abundantly available by using graphics boards which are also abundantly available. In particular, it is an object of this invention to take 7, 8, 10, 12 or higher bit gray scale data and display high quality gray scale images on VGA monitors driven by VGA graphics boards wherein all the information in the data is used to produce the largest pallet of gray shades possible.

In one aspect, the invention may including a bypass circuit having a switch connected between the computer and the monitor. In a first position, the switch delivers discrete analog signals defining color graphics to their respective monitor channels producing a colored image. When flipped into a second position, the switch activates the interface and passes the enhanced signal to all monitor inputs producing an enhanced gray scale image.

Thus, another object of this invention is to provide a mechanism whereby a single colored monitor can be used either in its normal mode as a colored monitor or as a gray scale monitor to produce a high quality gray scale image.

The present invention also includes a method to be used for producing a high resolution gray scale image on a monitor. The monitor has a plurality of monitor channels wherein a computer provides an analog signal corresponding to each monitor channel. The analog signals including at least a first and a second analog signal. The method comprises the steps of receiving the plurality of analog signals, reducing a second of the analog signals to produce an augmented signal, adding the first analog signal and the augmented signal to produce an enhanced signal, and conveying the enhanced signal to all monitor channels.

A preferred method also includes the steps of receiving x-bit gray scale data bytes (where x is greater than n), storing the most significant n bits of the x-bit gray scale byte as a first n-bit digital byte, storing the remaining x(-)n bits of the x-bit gray scale byte as the most significant bits of a second n-bit digital byte, decoding the first n-bit digital byte to produce the first analog signal, and decoding the second n-bit digital byte to produce the second analog signal.

Another object of the invention is to provide a method by which 7, 10, 12 or higher bit gray scale data can be used to produce high quality gray scale images using graphics boards and monitors which are already in abundant supply. In particular, this method allows high bit gray scale data to be used with VGA graphics boards to produce images on VGA or gray scale monitors.

The invention also includes a computer graphics interface for producing an enhanced gray scale image on a color VGA monitor having three channel inputs, the interface converting a first, a second, and a third analog signal into a single enhanced gray scale signal. The interface comprises three input amplifiers, each input amplifier receiving a different one of the color analog signals. A divider divides the second analog signal by a predetermined dividend to produce a divided second analog signal. An op-amp operates as a summer to add the first analog signal and the divided second analog signal to form an enhanced gray scale signal. Then, the enhanced gray scale signal is conveyed to all three color monitor channel inputs to produce a high quality gray scale image.

Other objects, advantages and features of the present invention will become apparent from the following specification when taken in conjunction with the accompanying drawings.

DESCRIPTION OF THE PREFERRED EMBODIMENT

Figure 1:
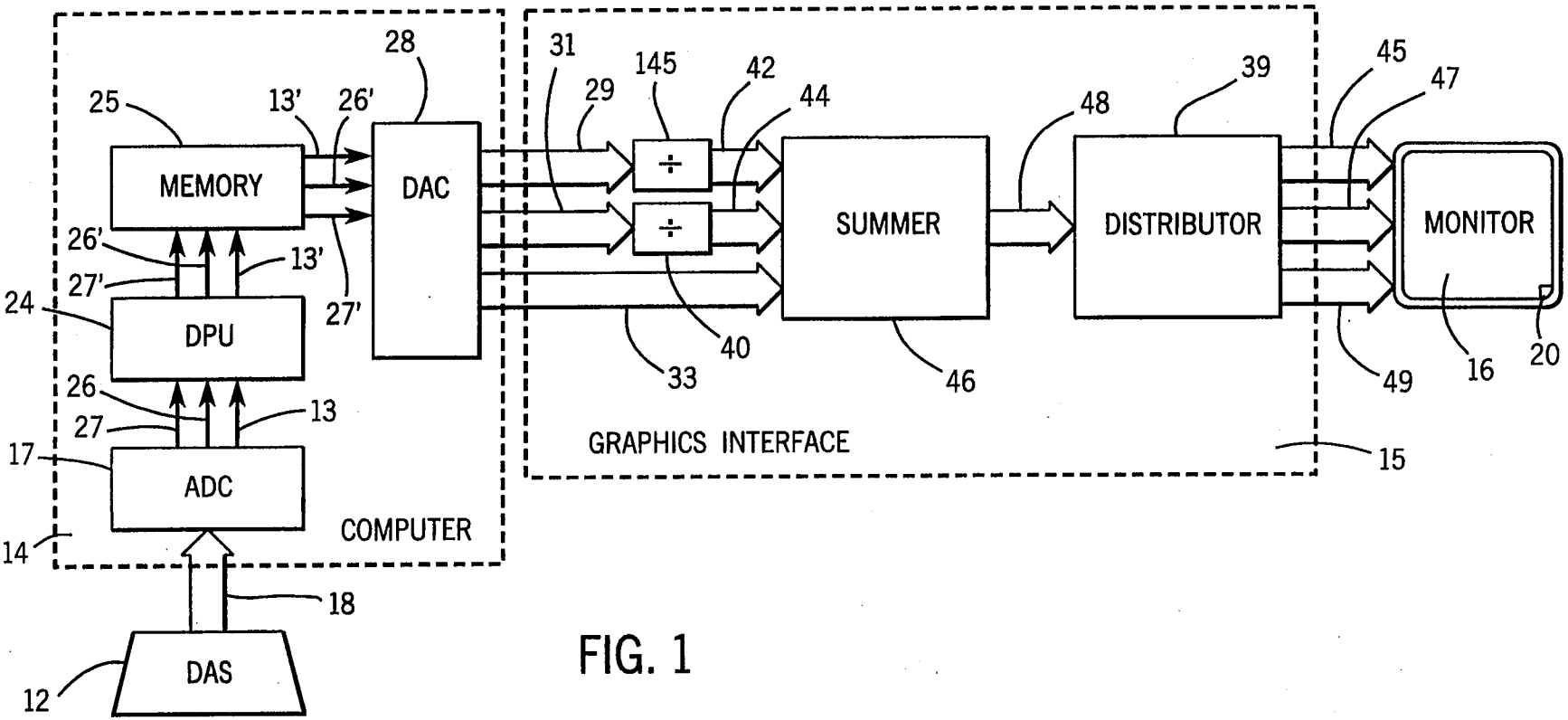
FIG. 1 is a schematic block diagram showing the graphics interface of the present invention and other fundamental parts of a computer imaging system.

Referring to FIG. 1, a medical imaging system 10 suitable for use with the present invention includes a data acquisition system (DAS) 12, a digital computer 14 which receives, processes and stores data furnished by the data acquisition system 12, and a monitor 16 for displaying images. The present invention resides in a graphics interface 15 which is positioned in series between the computer 14 and the monitor 16.

For the purposes of this description, the explanation of the present invention will be limited to an imaging system 10 wherein a color Vector Graphics Adaptor (VGA) monitor 16 is employed. It should be understood, however, that the present invention can be used with other types of monitors 16 which are driven by VGA graphics boards with only minor design changes which would be easy for one of ordinary skill in the art to implement. For example, the present invention could be used with a VGA graphics board to drive a high resolution gray scale monitor with a 7 (or more) bit gray scale pallet.

Figure 2:
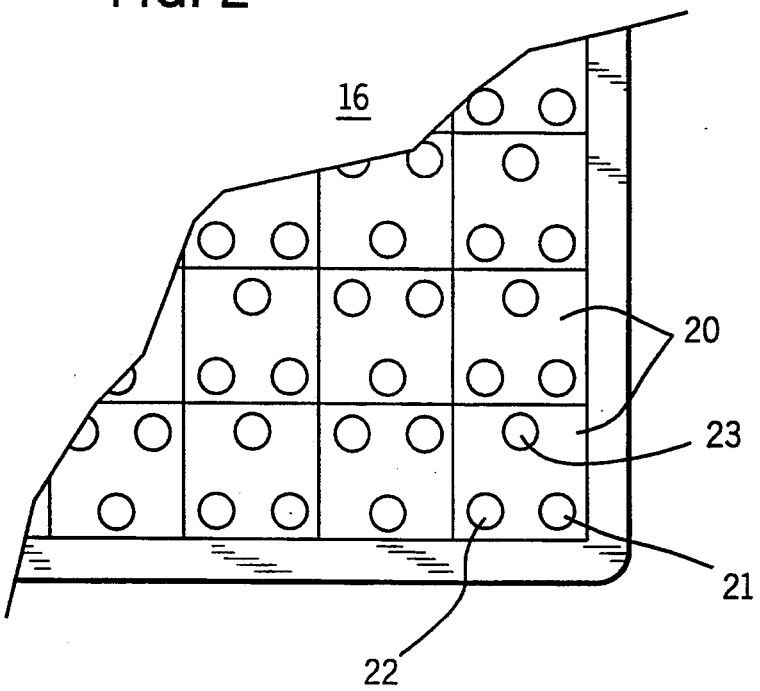
FIG. 2 is a blown up view of a plurality of monitor pixels.

Referring to FIGS. 1 and 2, the screen of a VGA monitor 16 consists of a plurality of pixels 20 arranged in rows and columns across the face of the screen. Each pixel 20 consists of a triad of red, blue, and green phosphorus dots 21, 22, and 23 respectively. Normally, the computer 14, which either has a built-in interface or a special display driver card either of which drives the VGA monitor 16, reserves a 6-bit byte in memory 25 for each phosphorous dot 21, 22, 23. Each 6-bit byte contains a binary code which indicates the voltage to be applied to its associated phosphorous dot 21, 22, 23. As the dots 21, 22, 23 are densely packed together, when associated dots are illuminated, an observer sees one color (an average of the colors of all three dots), not three. By varying the voltages applied to associated dots 21, 22, 23, the color, hue and intensity of each pixel can be adjusted. Thus, because standard VGA hardware uses a three 6-bit byte format, VGA data must be stored in that manner.

Referring to FIG. 1, the DAS 12 may be either a camera or a detector array such as those used with PET scanners, MRI machines, tomographic machines, topographic machines, X-ray machines, ultrasound machines, heat sensing machines or the like. Depending upon the nature of the imaging system 10, the DAS 12 may provide either digital gray scale bytes of data or analog signals representative of gray scale data.

Figure 3A:
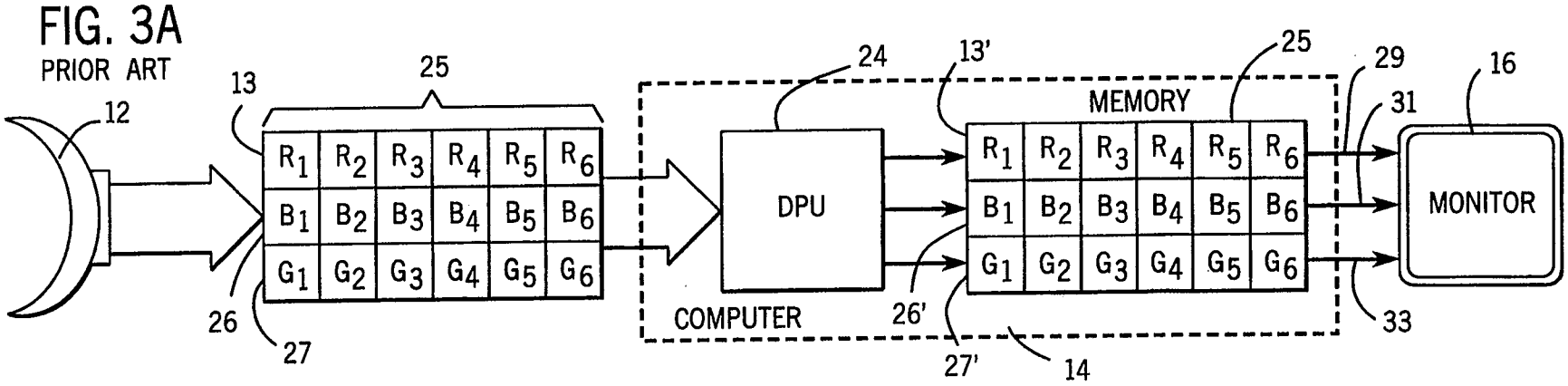
FIG. 3A PRIOR ART
FIG. 3A is a schematic block diagram showing data manipulation in a prior art imaging system.
Figure 3B:
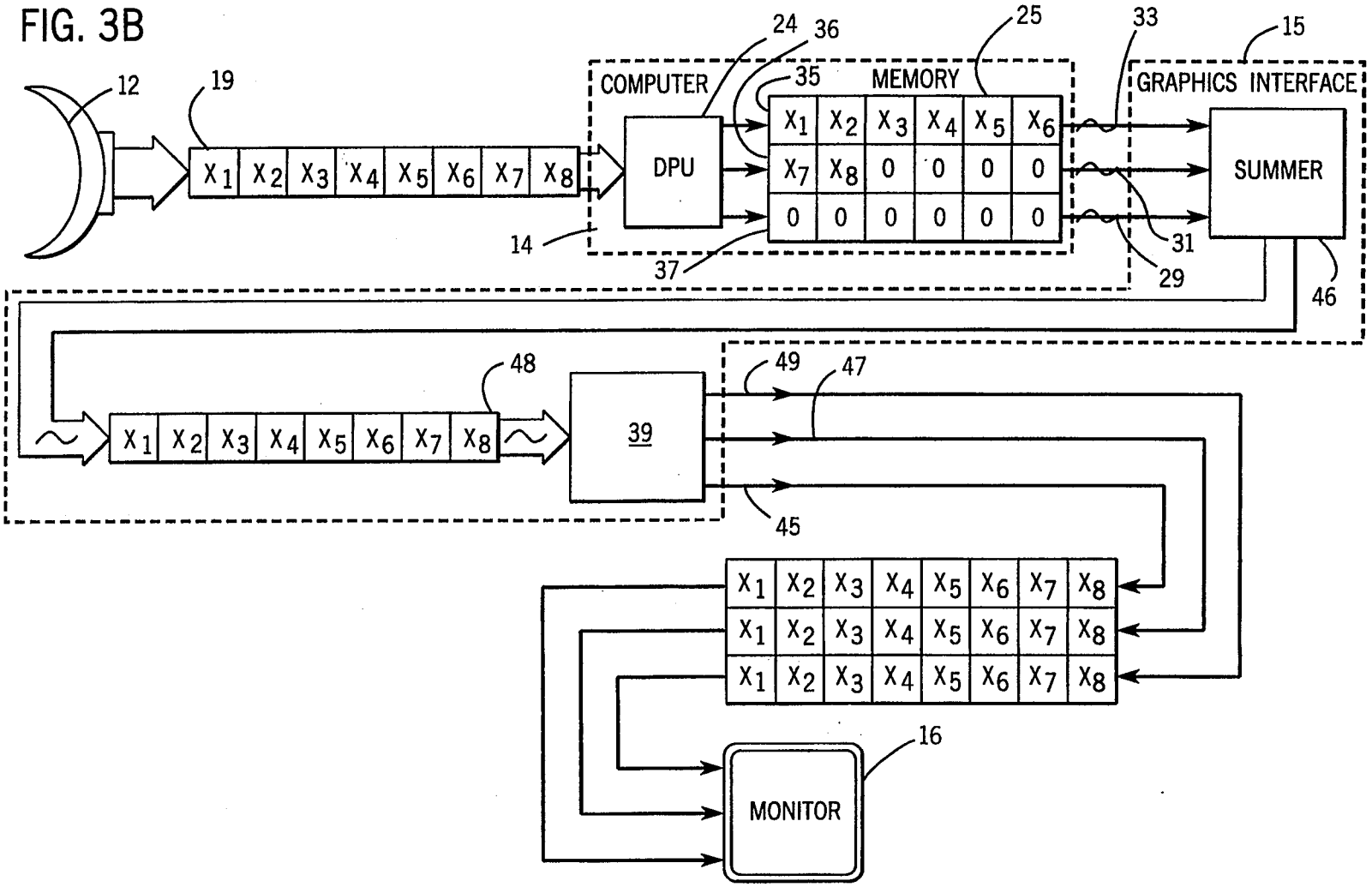
FIG. 3B is a schematic block diagram showing data manipulation in an imaging system employing the present invention.

Referring to FIGS. 1 and 3A and 3B, FIG. 1 shows a basic block diagram of an imaging system employing the present invention, FIG. 3A shows the bit mapping for a prior art system, and FIG. 3B shows the bit mapping for an imaging system employing the present invention.

Referring now specifically to FIGS. 1 and 3A, in the prior art, the DAS 12 provides either three 6-bit digital bytes 13, 26, 27 of information or a plurality analog signal 18 to the computer 14 corresponding to each pixel 20 on the monitor 16. As shown in FIG. 1, where the DAS 12 provides analog signals 18, the computer 14 must be equipped with an analog to digital converter (ADC) 17 to encode the analog signals 18 as digital signals 13, 26, 27 prior to processing by the computer 14.

After processing the 6-bit digital data bytes 13, 26, 27, a data processing unit (DPU) 24 stores the processed bytes 13', 26', 27' in memory 25. Once all the data associated with an image is properly stored, a digital to analog converter (DAC) 28 (shown in FIG. 1) converts digital bytes 13', 26', 27' into three analog signals 29, 31, 33. As seen in FIG. 3A, these analog signals 29, 31, 33 are representative of the 6-bit digital bytes 13', 26', 27' which proscribed each analog signal amplitude. The three analog signals 29, 31, 33 are passed onto the monitor 16 and a colored image is generated.

Referring to FIGS. 1 and 3B, in the preferred embodiment described below, rather than providing three 6-bit bytes of color data to the computer 14 for every pixel 20 on the monitor 16, the DAS furnishes an 8-bit (or 10-bit or 12-bit) gray scale digital byte 19 corresponding to each pixel 20 on the monitor 16. Each digital byte 19 is provided to the DPU 24 which may perform a plurality of functions thereon. With some imaging systems, each digital byte 19 must be processed in order to produce a second set of digital data which can create a useful image on the monitor 16. For example, with a CT machine, it may be necessary to perform a back projection process to produce the second set of digital data. Back projection processes are well known in the art. If necessary, the DPU can perform this function.

As indicated above, where a VGA monitor 16 is employed, the computer 14 stores graphics data for each pixel 20 in a format of three 6-bit bytes 35, 36, 37. Thus, each 8-bit (or higher) byte 19 of the set of digital data must be split into at least two smaller bit bytes. This process can easily be performed by the DPU 24 using a simple software algorithm, or a simple look-up table. In brief, what the algorithm or look-up table does is map the 8-bit grey scale byte 19 into two of the bytes 35, 36 normally assigned to colors of the VGA system. The most significant 6-bits (X1–X6 in FIG. 3B) are assigned to one color data byte 35 and the remaining 2 (or 4 or 6) data bits (X7 and X8 in FIG. 3B) of each gray scale byte 19 are assigned to a different VGA color byte 36.

The DPU thus masks off the two least significant bits (X7 and X8) of each 8-bit byte 19. The six most significant bits (X1–X6) are stored as a 6-bit byte 35 in the memory location associated with the green phosphorous dot 22 of an associated pixel 20. The DPU 24 performs a logical operation on the 8-bit byte 19 by effecting a six bit shift from low to high to move the two least significant bits (X7 and X8) in the 8-bit byte 19 into the most significant positions. The DPU then stores the two least significant bits (X7 and X8) as a second 6-bit byte 36 in the memory location associated with the blue dot 23 of the associated pixel 20. (This byte would be 4-bit for 10-bit gray scale or 6-bit for 12-bit gray scale.) In this example, the 6-bit byte 37 associated with the red phosphorous dot 21 of each pixel 20 is ignored (i.e. no data is stored therein).

Next, still referring to FIGS. 1 and 3B, the DAC 28 converts the digital information stored in the 6-bit bytes 35, 36, 37 into three analog signals 29, 31, 33. With the present invention, as gray scale rather than colored data is represented by the blue and green analog signals 31, 33, and no useful data is represented by the red analog signal 29, the gray scale data must be unscrambled and reassembled to produce the desired gray scale image. Thus, with the present invention, the red, blue and green analog signals 29, 31, 33 are intercepted by the graphics interface 15.

As each analog signal 29, 31, 33 is associated with a 6-bit byte 35, 36, 37, each signal can assume one of 26, or 64 discrete amplitudes and hence can generate sixty-four different dot intensities. However, the sixty-four intensities which each analog signal 29, 31, 33 can generate are identical for the red, green and blue analog signals. As the two least significant bits (X7 and X8) of the 8-bit gray scale byte 19 are carried by the blue signal 31, the blue signal 31 can generate 22, or four intensities by itself. However, these four intensities are identical to four of the sixty-four intensities which the green signal 33 can generate. Therefore, the graphics interface 15 modifies the amplitude of the blue signal 31 so that the four intensities it can generate are different (i.e. lower) than each of the sixty-four possible intensities the green signal 33 can generate.

Analog signal modification is accomplished by a first divider 40 which reduces the blue signal 31 and produces a first augmented signal 44. In the preferred embodiment, the blue signal 31 is reduced by dividing it by $2^6$, or sixty-four. As such, the augmented signal 44 provides smaller intensity increments than those which are achievable by the green signal 33. This is the desired result since the two bits (X7 and X8) represented by the blue signal 31 are the two least significant bits of the original 8-bit gray scale byte 19.

Next, a summer 46 adds the green signal 33 and the augmented signal 44 to produce an enhanced signal 48. As shown in FIG. 3B, this enhanced signal 48 is representative of the 8-bit gray scale data byte 19 (X1–X8) stored in the green and blue memory locations. As such, the enhanced signal 48 can assume 256 different amplitudes.

A distributor 39 then passes the enhanced signal 48 to the red, blue and green monitor channels 45, 47, and 49 respectively. The enhanced signal 48 is used by the monitor 16 to control the electron beam intensities directed at all three dots 21, 22, 23 for each pixel 20.

Still referring to FIG. 3B, as all of the enhanced analog signals 45, 47, 49 fed to the monitor 16 are equal (i.e. the enhanced signal 48 has been passed to all channels), the pixel 20 associated therewith will assume a gray shade. As eight bits of digital data define each gray shade in the preferred embodiment, 28, or two hundred and fifty-six, shades of gray should be achievable.

Figure 4:
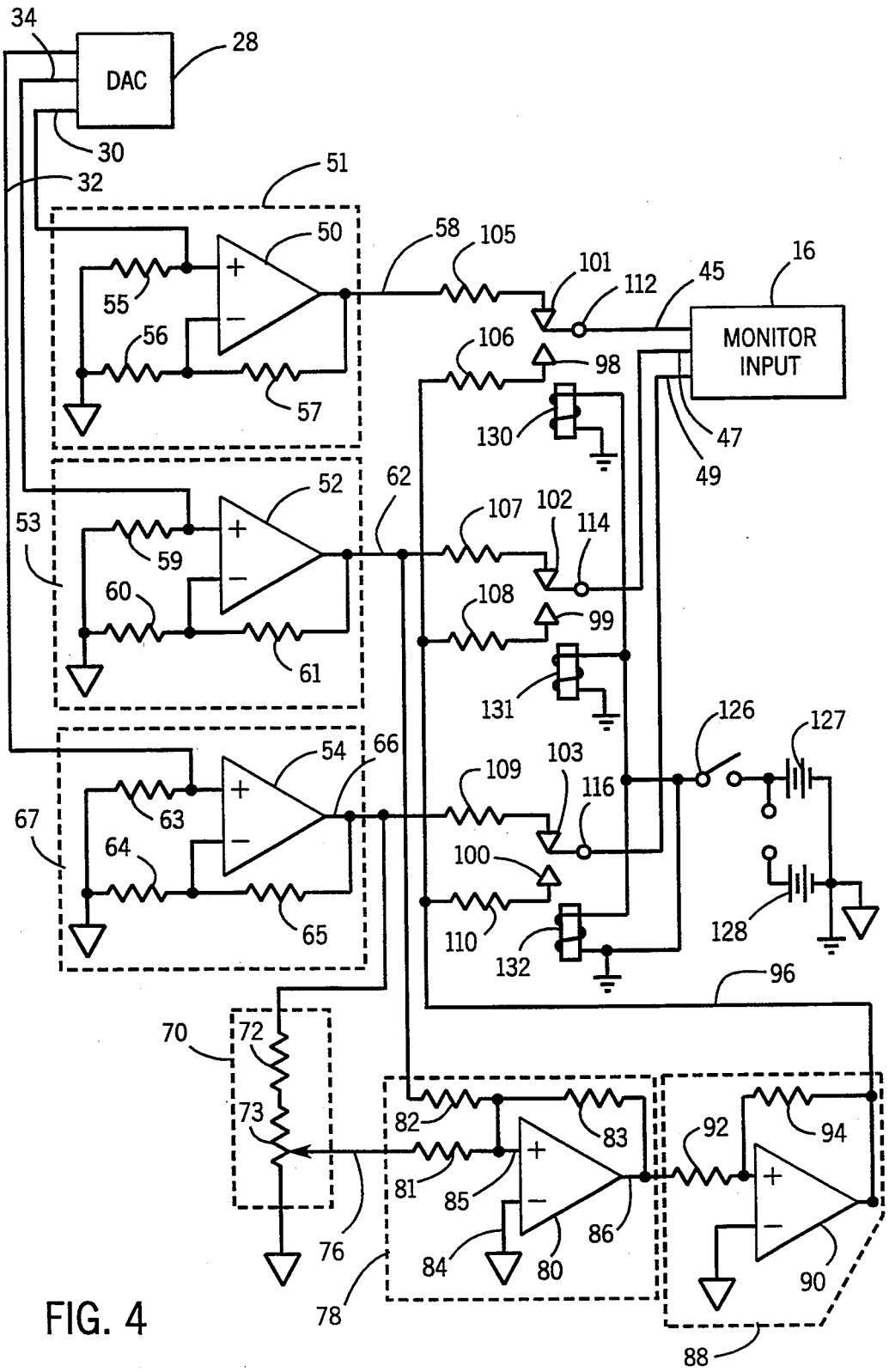
FIG. 4 is a circuit diagram of the preferred embodiment of the present invention.

Referring now to FIG. 4, in preferred embodiment, graphics interface 15 receives the red, blue and green analog signals 30, 32, 34. Each signal 30, 32, 34 is provided to the positive input of its own operational amplifier 50, 52, and 54. As well known in the art, three resistors 55, 56, 57 are arranged with, and connected to, operational amplifier 50 so as to construct a voltage doubling amplifier 51 (i.e. the amplitude of an amplified red signal 58 is twice that of red signal 30). This is done by choosing appropriate resistor values for resisters 55, 56 and 57 wherein the impedances of resistors 56 and 57 are identical.

In a like manner, three resisters 59, 60 and 61 are selected, arranged with, and connected to, operational amplifier 52 to produce a voltage doubling amplifier 53 which outputs an amplified green signal 62 that has twice the amplitude of green signal 34. Resisters 63, 64, and 65 are selected, arranged with, and connected to, operational amplifier 54 to form a third voltage doubling amplifier 67 providing amplified blue signal 66.

In the preferred embodiment, the amplified blue signal 66 is provided to a reduction circuit 70. The reduction circuit 70 consists of a first resister 72 in series with a variable resister 73. The variable resistor 73 acts as a voltage divider in a manner well known in the art. In the preferred embodiment, the reduction circuit 70 produces an augmented signal 76 which is 1/64th the voltage of the amplified blue signal 66. However, it should be understood that the reduction circuit 70 can be used to adjust the voltage reduction of the augmented signal 76 to achieve various ranges of possible augmented signals by dividing blue signal 66 by a different dividend. This provides an easy method by which a user can adjust the gray scale pallet to suit diagnostic needs.

Next, amplified green signal 62 and augmented signal 76 are provided to a summing amplifier 78 which is well known in the art. The summing amplifier 78 adds the amplified green and augmented signals 62, 76 to produce an enhanced signal 86. The summing amplifier 78 consists of an operational amplifier 80 and three suitably arranged resisters 81, 82 and 83. As the negative terminal 84 of the operational amplifier 80 is grounded, the voltage at both the negative 84 and positive 85 terminals must be zero. Therefore, if impedances of resisters 81, 82 and 83 are identical, the enhanced signal 86 must equal the negative of the sum of the amplified green signal 62 and the augmented signal 76.

The enhanced signal 86 is directed to distribution amplifier 88 which is also well known in the art. Distribution amplifier 88 consists of an operational amplifier 90 and two resisters 92, 94. If the impedance of resistor 94 is twice that of resistor 92, amplified enhanced signal 96 will be inverted and twice the amplitude of the enhanced signal 86. The amplified enhanced signal 96 is provided to a first red terminal 98, a first blue terminal 99 and a first green terminal 100.

In the preferred embodiment, amplified red, green and blue signals 58, 62 and 66 are provided to a second red terminal, second green terminal, and second blue terminal 101, 102, and 103 respectively. Resisters 105, 106, 107, 108, 109 and 110 are impedance matching resisters as known in the art (in the preferred embodiment each is 75 ohms).

Three solenoid activated switches 112, 114, 116 are provided. These switches 112, 114, 116 are moveable between a first position (shown in FIG. 3) wherein each switch 112, 114, 116 completes a circuit with an associated first terminal 98, 99, and a second position (not shown) wherein each switch 112, 114, 116 completes a circuit with an associated second terminal 101, 102, and 103.

When the switches 112, 114, 116 are in the first position, the amplified red, green, and blue signals 58, 62, 66 are passed through the graphics interface 36 without modification and are provided at the red, green and blue monitor channels 45, 47, and 49. In this position, the VGA monitor operates as a normal colored VGA screen producing colored images.

When the switches 112, 114, 116 are in the second position, the amplified enhanced signal 96 is passed onto the monitor channels 45, 47 and 49. In this mode, all 8-bit gray scale data provided by the DAS 12 is used by the VGA monitor to produce a high quality gray scale image.

A master switch 126 for selecting between signals 58, 62 and 66 and the amplified enhance signal 96 is provided. When the master switch 126 is opened, the solenoid switches 112, 114, and 116 are in the first position. When the master switch 126 is closed, two batteries 127, 128 provide a DC voltage which activates solenoids 130, 131, 132, forcing the switches 112, 114, 116 into their second position.

Figure 5:
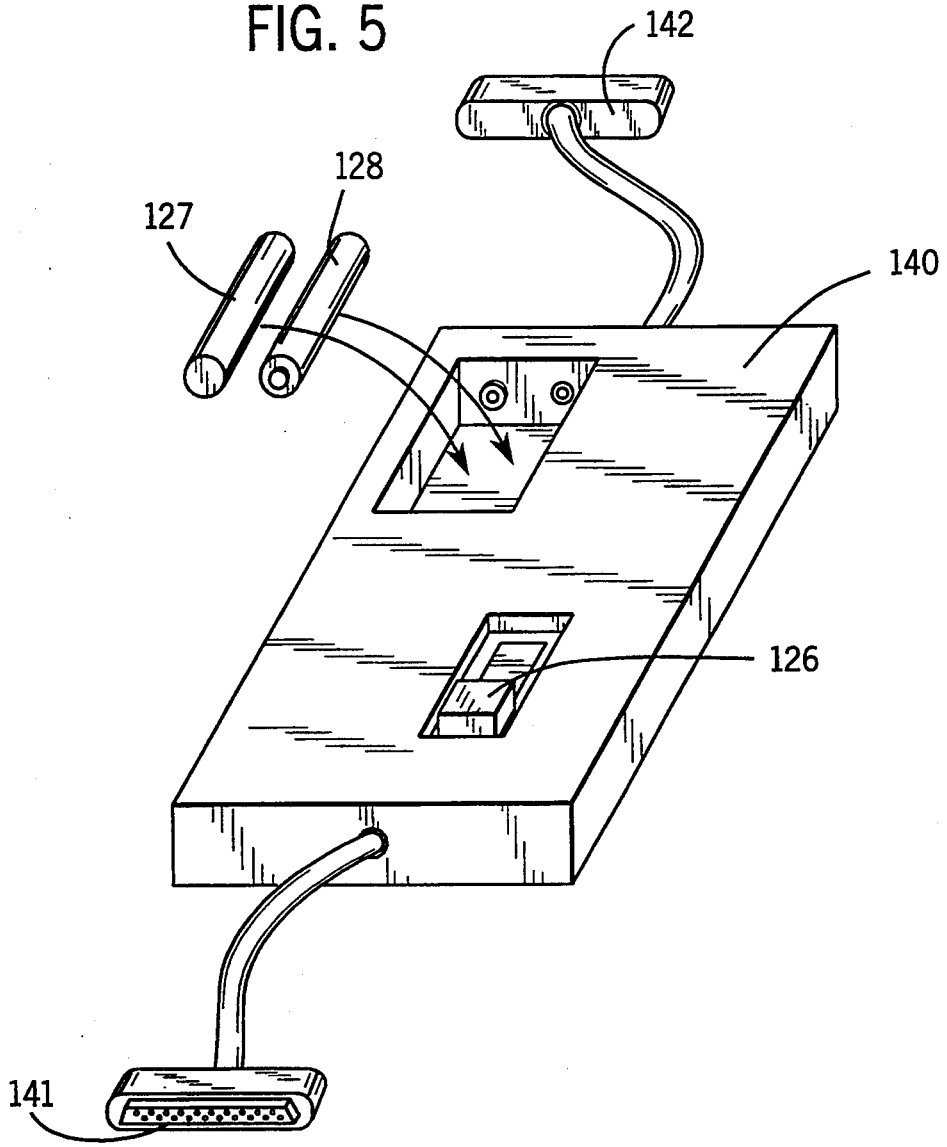
FIG. 5 is a perspective view of a case and connector plugs for housing the present invention.

Referring to FIGS. 1, 4 and 5, the entire graphics interface 15 can be built into a small case 140 and positioned between the computer 14 and the monitor 16. In the preferred embodiment, the interface 15 has a multipronged male plug 141 on its computer end and a multiport female plug 142 on its monitor end. Therefore, standard computer cables (not shown) can be used to transfer information between the computer 14 and the interface 15, and between the interface 15 and the monitor 16. A battery alcove 143 should be positioned so that batteries 127, 128 can easily be replaced. In addition, the master switch 126 should be positioned for easy operation.

The above description has been that of a preferred embodiment of the present invention. It will occur to those who practice the art that many modifications may be made without departing from the spirit and scope of the invention. For example, where a graphics board is capable of producing three 8-bit data bytes on each channel of a monitor, the present invention could be modified to distribute one 8-bit gray scale byte corresponding to each pixel to all monitor channels. In the alternative, the present invention could be used with such an 8-bit board to provide analog signals corresponding to 9 (or more) bit digital bytes to each channel of a monitor. Thus, the present invention can be used as an interface between graphics cards having various characteristics and a plurality of different types of colored monitors.

Also, by providing a buffer amplifier (not shown) between the distribution amplifier 88 and a monitor 16, the signals controlled by the VGA board can be timed appropriately so that they can drive a high resolution monochrome (gray scale) monitor.

Referring to FIG. 1, in order to use thirteen or more bit gray scale data with a standard VGA graphics board, the DPU 24 can store the thirteen plus bits as a red digital byte 13' which produces a red analog signal 29. A second divider 145 can be added to the graphics interface 15 to divide the red signal 29 and produce a second augmented signal 42. This second augmented signal 42 may then be added to the first augmented signal 44 and the green signal 33 to produce an enhanced signal 48 which represents thirteen (or more) bits of digital data.

Also, there is no reason why an 8-bit (10-bit, 12-bit . . . ) digital byte could not be divided and stored as three bytes corresponding to three monitor channels. This could allow for additional enhancement features. For example, by "expanding" 8-bit data into 16-bit, where data bits are shifted so that a 0 is positioned between each original bit of the 8-bit byte, storing the 16-bit byte in the three 6-bit byte memory locations associated with a pixel 20, and delivering the three 6-bit bytes to the graphics interface 15 for conversion, the range of gray shades would still be 256, but the gray shades would be different. Not only would the gray shades be different, but the incremental darkness between similar shades on the pallet would be greater which, for some diagnostic purposes, could be useful.

As the human eye is capable of perceiving gray scale changes more readily in certain gray scale ranges than in others, a designer could choose between different gray scale ranges, or even specific gray shades, that make up a pallet by using software which allows gray scale bits to be mapped to different positions in the three 6-bit bytes in a manner similar to that described in the proceeding paragraph. This invention can take any gray scale VGA bit mapping and create a gray scale image.

Thus, it can be seen that the present invention allows a user to use 7-bit (or higher) gray scale data to generate gray scale images on a plurality of different types of monitors using either a VGA graphics board or some other suitable graphics board. The invention is an inexpensive and simple solution which employs monitors and graphics boards which are already in abundant supply.

In order to appraise the public of the various embodiments that may fall within the scope of the invention, the following claims are made:

We claim:

1. A computer graphics interface positioned in series between a data acquisition system and a monitor for displaying gray scale images on the monitor, the monitor having a plurality of separate inputs, the interface comprising:

a. a discrete array of n-bit digital bytes;

b. a processing unit to receive x-bit gray scale data where x is greater than n, the processing unit stores the x-bits of gray scale data among the n-bit digital bytes, the most significant bit of the x-bit gray scale data being stored in the first digital byte and less significant bits being stored in subsequent bytes;

c. a digital to analog converter for converting the n-bit digital bytes into a plurality of analog signals, one analog signal for each monitor input, each digital byte determining the amplitude of an associated analog signal and being capable of encoding $2^n$ different analog signal amplitudes;

d. an interface input for receiving the analog signals;

e. a divider for reducing a second of the analog signals to produce an augmented signal;

f. a summer for adding a first of the analog signals and the augmented signal to produce an enhanced signal; and g. means for conveying the enhanced signal to each of the plurality of monitor channels.

2. The computer graphics interface as recited in claim 1 wherein the monitor is a color VGA monitor having three color inputs, where n is 6, and the divider reduces the second analog signal by dividing the second analog signal by 64.

3. The computer graphics interface as recited in claim 1 wherein the processing unit stores the most significant n-bits of the x-bit gray scale data as a first n-bit digital byte and stores the remaining x(-)n bits of the x-bit gray scale data as the most significant bits of a second n-bit digital byte.

4. The computer graphics interface as recited in claim 3 further comprising a second divider for reducing a third of the analog signals to produce a second augmented signal, wherein the summer adds the first analog signal, the augmented signal and the second augmented signal to produce the enhanced signal.

5. The computer graphics interface as recited in claim 4 wherein the divider reduces the third analog signal by dividing the third analog signal by $2^{12}$.

6. The computer graphics interface as recited in claim 1 further including a bypass circuit having a switch connected between the computer and the monitor whereby a user can chose to either pass on the plurality of analog signals to the separate monitor inputs or pass on the enhanced signal to all monitor inputs.

7. A computer graphics interface for producing an enhanced gray scale image on a color VGA monitor having 3 color channel inputs, the interface converting a first, a second, and a third analog signal into a single enhanced gray scale signal, the interface comprising:

a. three input amplifiers, each input amplifier receiving a different one of the three analog signals;

b. a divider for dividing the second analog signal by a predetermined dividend to produce a divided second analog signal;

c. an op-amp which operates as a summer to add the first analog signal and the divided second analog signal to create a single enhanced gray scale signal;

d. means for conveying the enhanced gray scale signal to all three color channel inputs; and e. a switch connected between the computer and the monitor whereby a user can choose to either pass on the first, second, and third analog signals to the color channel inputs or pass on the enhanced analog signal to the three color channel inputs.

8. A method to be used with a computer graphics interface for producing a high resolution gray scale image on a color monitor having a plurality of monitor channels wherein a computer provides an analog signal corresponding to each monitor channel, the analog signals including at least a first and a second analog signal, the method comprising the steps of:

a. receiving x-bit gray scale data where x is greater than n;

b. storing the most significant n bits of the x-bit gray scale data as a first n bit digital byte;

c. storing the remaining x (-) n bits of the x-bit gray scale data as the most significant bits of a second end bit digital byte;

d. decoding the first n bit digital byte to produce the first analog signal;

e. decoding the second n bit digital byte to produce the second analog signal;

f. reducing the second analog signal to produce an augmented signal;

g. adding the first analog signal and the augmented signal to produce an enhanced analog signal; and h. conveying the enhanced analog signal to all monitor channels.

9. A method for use with a computer for displaying gray scale images on a monitor, the monitor having a plurality of separate inputs, the computer maintaining a discrete array of n-bit digital bytes, one digital byte corresponding to each monitor input, the method comprising the steps of:

a. receiving x-bit gray scale data where x is greater than n;

b. storing the x-bit gray scale data among the n-bit digital bytes, the most significant bit of the x-bit gray scale data being stored in a first digital byte and less significant bits being stored in subsequent bytes;

c. converting the n-bit digital bytes into a plurality of analog signals, one analog signal for each monitor input, each digital byte determining the amplitude of an associated analog signal and being capable of encoding $2^n$ different analog signal amplitudes, a first analog signal corresponding to the first digital byte;

d. reducing a second of the analog signals to produce an augmented signal;

e. adding the first of the analog signals and the augmented signal to produce an enhanced signal; and f. conveying the enhanced signal to each of the plurality of monitor channels.

* * * * *